United States Patent [19]

Gross

[11] Patent Number: 4,588,474

[45] Date of Patent: May 13, 1986

[54] CHEMICAL MILLING PROCESSES AND ETCHANTS THEREFOR

[75] Inventor: Donald W. Gross, San Diego, Calif.

[73] Assignee: Chem-tronics, Incorporated, El Cajon, Calif.

[21] Appl. No.: 605,830

[22] Filed: May 1, 1984

Related U.S. Application Data

[63] Continuation of Ser. No. 231,173, Feb. 3, 1981, abandoned.

[51] Int. Cl.[4] ..... C23F 1/02; B44C 1/22; C03C 15/00; C03C 25/06

[52] U.S. Cl. ..... 156/659.1; 156/651; 156/654; 156/661.1; 156/665; 252/79.5

[58] Field of Search ..... 156/651, 654, 656, 659.1, 156/661.1, 665; 252/79.5, 156; 204/129.1, 129.65; 134/29, 41

[56] References Cited

U.S. PATENT DOCUMENTS

| | | | |
|---|---|---|---|
| 2,472,304 | 6/1949 | Mason | 252/79.5 X |
| 2,671,717 | 3/1954 | Ferguson . | |
| 2,673,143 | 3/1954 | Dufrene et al. . | |
| 2,795,491 | 6/1957 | Newman et al. . | |
| 2,942,955 | 6/1960 | Hannah | 252/79.5 X |
| 3,039,909 | 6/1962 | DeLong et al. | 156/637 |
| 3,039,910 | 6/1962 | Zelley | 156/665 |
| 3,061,494 | 10/1962 | Snyder et al. . | |
| 3,134,702 | 5/1964 | DeLong et al. . | |
| 3,300,349 | 1/1967 | Tershin et al. . | |
| 3,356,550 | 12/1967 | Stiffler et al. . | |
| 3,557,000 | 1/1971 | Smith | 252/79.5 |
| 3,690,949 | 9/1972 | Ng | 252/79.5 X |
| 3,802,973 | 4/1974 | Smith | 252/79.5 X |
| 3,957,553 | 5/1976 | Smith | 252/79.5 X |
| 4,113,549 | 9/1978 | Brimm | 156/639 |

FOREIGN PATENT DOCUMENTS

| | | | |
|---|---|---|---|
| 2439202 | 2/1976 | Fed. Rep. of Germany | 252/79.5 |
| 4828541 | 5/1969 | Japan | 252/79.5 |

*Primary Examiner*—William A. Powell
*Attorney, Agent, or Firm*—Hughes & Cassidy

[57] ABSTRACT

Aqueous chemical milling solutions for aluminum and aluminum alloys. These solutions contain a caustic; a nitrate or nitrite; and, optionally, a diol or polyol such as ethylene glycol or glycerin. Chemical milling processes which employ such solutions.

30 Claims, 4 Drawing Figures

CHEMICAL MILLING PROCESSES AND ETCHANTS THEREFOR

This is a continuation of application Ser. No. 231,173 filed, Feb. 3, 1981, now abandoned.

In one aspect the present invention relates to chemical milling processes and, more particularly, to novel improved processes for milling aluminum and its alloys, particularly those with appreciable zinc and copper contents.

In another aspect my invention relates to novel, improved chemical milling solutions for use in processes of the character just described.

Chemical milling is a process in which appreciable amount of metal are removed from a workpiece by first masking the workpiece with a protective coating and then attacking the exposed metal with an acid or caustic solution to etch the metal away and thereby impart a wanted configuration to the workpiece. One state-of-the-art process, which is so sophisticated that it can be used to reduce a uniform section to one having a thin skin with T-sectioned, reinforcing ribs, is disclosed in U.S. Pat. No. 4,113,549 issued Sept. 12, 1978, to Brimm.

Chemical milling can be used to particular advantage in applications where complex configurations and close tolerances are involved because of the difficulty and cost of forming such parts by machining and other traditional manufacturing techniques. The process is, because of the foregoing advantages, especially useful in the aircraft, aerospace, and related industries where weight is at a premium and weight reduction can be best obtained by employing components of the character just described.

In the foregoing, and other industries, aluminum alloys are extensively used; and a number of techniques and chemical formulations for chemically milling such alloys have been proposed. Those prior approaches are not entirely satisfactory however. I have accordingly invented novel, and improved, processes and solutions for chemically milling aluminum and its alloys that are free of the disadvantages which those heretofore proposed have.

The first step in my novel technique for chemically milling aluminum alloys is the cleaning of the workpiece to remove surface contaminants that might interfere with the subsequent milling of the workpiece. Typically, this may involve degreasing of the workpiece with a standard solvent and immersion in an alkaline cleaner to remove surface oxides.

Next, the workpiece is masked to protect from chemical attack those areas of the workpiece where the removal of metal is not wanted. Typical techniques for masking the workpiece and stripping the mask away from those areas where metal is to be removed are described in the above-cited U.S. Pat. No. 4,113,549 to which the reader may refer, if desired.

Then, the cleaned and masked workpiece is immersed in a bath of chemical milling solution to effect the removal of metal from the unmasked parts of the workpieces. The workpiece may be mounted in a dynamic milling fixture as disclosed in U.S. Pat. No. 4,113,549 to promote uniform milling in this step, if desired.

In thus milling aluminum alloys I depart from heretofore proposed processes by employing as the chemical milling agent an aqueous solution containing from 80 to 120 grams per liter of an alkali metal hydroxide or ammonium hydroxide calculated as sodium hydroxide and from 42 to 65 grams per liter of an alkali metal nitrate or ammonium nitrate calculated as sodium nitrate.

Sodium hydroxide and sodium nitrate are preferred as are formulations containing about 100 grams of the hydroxide and about 50 grams of the nitrate.

Other hydroxides that can be employed include those with lithium and potassium cations. However, these offer no advantages over sodium hydroxide; and they are considerably more expensive.

Similarly, potassium and other nitrates in addition to ammonium can be substituted for the sodium nitrate, if desired. This, too, is discouraged, however, as nothing is gained while the cost is higher.

Also, the sodium nitrate of my novel chemical milling solutions can be replaced with sodium nitrite and other nitrites; but this, too, is more expensive. Also, nitrites are less active and more difficult to control; and rougher surfaces are produced.

The solution is maintained at a temperature in the range of 190°-200° F. during the chemical milling step; a temperature of about 194° F. is preferred.

The time for which the workpiece is milled will of course depend upon the depth to which the metal is to be removed and the particular alloy being milled. Typically, from 300 to 400 minutes (5.0 to 6.7 hours) is required to remove 0.150 inch of metal.

The formulations just identified are the least expensive I know of in terms of cost per pound of metal removed. Only two, relatively inexpensive chemicals are required whereas commercially available and heretofore patented solutions for chemically milling aluminum alloys invariably include three or more such constituents; and one or more of these is often relatively exotic and correspondingly expensive.

Another important advantage of my novel chemical milling solutions is that an acceptable product can invariably be obtained. This remains true even when the workpiece is fabricated of an aluminum alloy having a high copper or zinc content. One important alloy of this type is Al 2219 which has the nominal composition 6.3Cu-0.3Mn-0.18Zr-0.10V-0.06Ti-Al. That alloy is available in sheet form and in the form of extrusions and forgings; and it is used extensively in the aircraft industry.

In a typical application, fabrication of a component from Al 2219 will involve the chemical milling of the workpiece to form a skin reinforced with T-sectioned ribs or fillets. Straight etch lines, smooth fillets, and smooth surfaces are required; and all of these are necessary to avoid an unacceptable product.

Other common aluminum alloys that can be milled to advantage by the process and with the chemical milling solutions described herein are:

| Designation | Composition |
|---|---|
| 2024 | *4.4Cu-0.6Mn-1.5Mg-Al |
| 7075 | *1.6Cu-2.5Mg-5.6Zn-0.23Cr-Al |
| 7079 | *0.6Cu-3.3Mg-0.18Cr-4.3Zn-0.20Mn-Al |
| 6061 | *0.30Cu-0.6Si-1.0Mg-0.20Cr-Al |

*Typical Composition

The foregoing shows that aluminum alloys with appreciable —i.e., high—zinc, as well as high copper, contents can be chemically milled in accord with the principles of the present invention and that my invention can also be used to mill aluminum alloys which do not have a high copper or zinc content.

Still another advantage of my novel chemical milling solutions is that their effectiveness does not decrease as the concentration of aluminum dissolved from the workpiece being milled increases in the solution. This contrasts directly with heretofore proposed solutions for chemically milling aluminum alloys as they invariably exhibit decreased effectiveness as dissolved aluminum content increases in my experience.

Formulations containing only a hydroxide and a nitrate in an aqueous carrier work perfectly well in many cases such as those involving the chemical milling of Al 2219 sheet stock. In other cases, however, I have found that even better results can be obtain by adding a polyol such as glycerin (1,2,3-propanetriol) or a diol such as ethylene glycol (1,2-ethanediol) to the chemical milling solution. Ethylene glycol, for example, makes the solutions more effective in milling Al 2219 extrusions; and they are more effective in milling Al 2219 forgings if glycerin is added. Solutions containing ethylene glycol and glycerin have also proven very effective in milling Al 2219 stock in various heat treated conditions in which such stock is supplied.

The part played by the glycol and glycerin has not yet been established. I have nevertheless consistently found that the use of those additives results in components with smoother surfaces and more uniform I and T sections than can otherwise be obtained.

From 5 to 15 volume percent of the diol or triol can be used with the best results being obtained when from 7.1 to 10 percent is used and the optimum concentration being in the range of 6–8 percent.

Small quantities of surface active agents can also be advantageously incorporated in my novel chemical milling solutions to increase their wettability. This is a common practice in chemical milling, however; and I accordingly do not consider it necessary to discuss this aspect of my invention further in this disclosure.

Formulations for etching and chemically milling aluminum alloys with appreciable copper and zinc contents, albeit quite unlike mine, have heretofore been described in U.S. Pat. Nos. 2,795,491 issued June 11, 1957, to Newman et al; 3,300,349 issued Jan. 24, 1967, to Tershin et al; and 3,356,550 issued Dec. 5, 1967, to Stiffler et al. I have tested these and a number of other patented and commercially available formulations without success. Invariably, I encountered such problems as wavy etch lines, uneven surfaces, channeling and chamfering in fillet areas. All of these defects are accompanied by a loss of strength, and they are consequently incompatible with the goal of maximum strengt at the lowest possible weight.

Other important drawbacks of the chemical milling solutions described in the foregoing patents are that they are more complicated and expensive than mine. Also, they contain compounds —sulfides and cyanides—which give off odorous, toxic fumes at the temperatures at which chemical milling baths are operated. To use these formulations at all under present day and forthcoming governmental regulations would consequently require elaborate equipment and controls, and that might well make the use of such formulations prohibitively expensive. In contrast my novel chemical milling solutions do not give off poisonous or smelly fumes.

Typically, after the workpiece is milled, it will be remasked and subjected to a second milling step to produce additional changes in configuration and/or to further lighten the component being fabricated. And even a third (or more) additional steps may be required for that purpose.

A further advantage of my novel chemical milling formulations is that the same solution can be used in all of the chemical milling steps. In contrast, multi-step processes previously proposed for chemically milling aluminum alloys with high zinc and copper contents such as that described in U.S. Pat. No. 3,356,550 require two or more different milling solutions. This, again, may be a prohibitively expensive approach.

Yet another advantage of my novel technique and formulations, mentioned above, is that they can be employed to mill aluminum alloys which do not have a high zinc or copper content or, indeed, any of those metals.

Chemical milling as discussed above and as that term is employed herein should be recognized by the reader as being something quite different from other processes involving a chemical attack on metals (see U.S. Pat. No. 3,061,494 issued Oct. 30, 1962, to Snyder et al).

One of the more-or-less unrelated processes identified in U.S. Pat. No. 3,061,494 is brightening or polishing. Processes of this type which employ chemical agents superficially resembling mine are described in U.S. Pat. Nos. 2,671,717 issued Mar. 9, 1954, to Ferguson and 2,673,143 issued Mar. 23, 1954, to Du Fresne et al.

These formulations are nevertheless quite dissimilar. They are intended to be used over a period of one to a few minutes to produce a polish on an unmasked workpiece, not to remove metal to a substantial depth in a controlled area, a process typically requiring several hours.

Furthermore, while they can contain sodium hydroxide and sodium nitrate, the Ferguson and Du Fresne et al formulations are not suitable for chemical milling.

Attempts to use the Ferguson solution for the extended periods required in chemical milling failed because of channeling, tapering, and poor control over the undercut ratio of the fillets I was attempting to form. Also, as the concentration of dissolved aluminum increased, the Du Fresne solution became less effective. My novel chemical milling solutions, in contrast, are not affected by dissolved aluminum as indicated above.

The Ferguson formulations contain much lower hydroxide and nitrate concentrations than I have found essential; and, as a result, they operate in a quite different fashion. The patentee points out that they generate a "substantially unetched surface." This contrasts directly with the significant removal of metal effected by novel chemical milling solutions.

In many cases the workpiece being milled will have a weld or other heat affected zone. Aluminum chemical milling formulations in common use preferentially attack the metal in such zones; and it is consequentially necessary to mask the weld and heat affected zones in order to obtain uniform milling.

My novel chemical milling formulations do not exhibit this preferential effect. It is accordingly unnecessary to mask heat affected zones of workpieces being fabricated by my novel chemical milling process, which is a substantial manufacturing advantage.

From the foregoing it will be apparent to the reader that one important and primary object of the present invention resides in the provision of novel, improved processes for chemically milling metallic workpieces.

A second and equally important object of my invention is the provision of novel, improved chemical milling solutions.

And a third important and primary object of my invention is to provide novel, improved processes and solutions for chemically milling aluminum and its alloys, especially those with appreciable copper and/or zinc contents.

Related, and also important, but more specific objects of my invention reside in the provision of chemical milling processes and solutions as characterized in the preceding objects:

which offer a significant cost advantage over the processes and solutions for chemically milling aluminum and its alloys that have heretofore been available;

which are capable of producing components with such desirable features as straight etch lines and smooth surfaces and fillets without undercutting, chamfering, channeling, or tapering even when the configuration being produced is complex;

which, by virtue of the features recited in the preceding object, can be relied upon to produce components with a high strength-to-weight ratio and a high degree of uniformity;

which can be used to chemically mill extruded and forged, as well as sheet, stock and which can be used to mill stock in various heat treated conditions;

which maintain their effectiveness in the face of increasing concentrations of dissolved aluminum in the milling solution;

which do not generate toxic or odorous fumes;

which allow the same solution to be used in all of the sequential chemical milling steps that may be involved in manufacturing a complex configuration; and which can be used to chemically mill workpieces containing welds because they do not preferentially attack the metal in the weld zones to an unacceptable extent, if at all.

Still other important objects of my invention are to provide solutions for chemically milling aluminum and its alloys:

in which the active principles are a combination of a caustic such as sodium hydroxide and a nitrate such as sodium nitrate (or, optionally, a nitrite);

which also contain a diol such as ethylene glycol to improve their capacity to mill aluminum extrusion;

which instead contain a polyol such as glycerin to improve their capacity to mill aluminum forgings.

Other important objects and features and additional advantages of my invention will become apparent from the appended claims and as the ensuing detailed description and discussion proceeds in conjunction with the accompanying drawing, in which:

Figure 1:
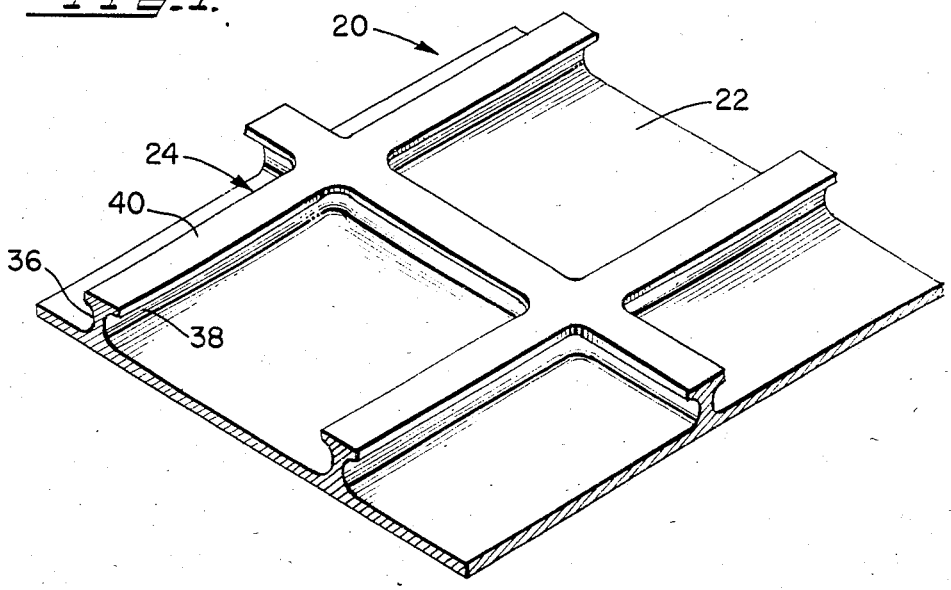
FIG. 1 is a fragmentary, pictorial view of an exemplary component that can be made by employing the novel chemical milling processes and solutions disclosed herein.

Referring now to the drawing, the component 20 illustrated fragmentarily in FIG. 1 and manufactured by chemically milling it from a workpiece (typically) of uniform section in accord with the principles of the present invention may be, for example, a jet engine compressor housing. The component is characterized by a thin skin 22 reinforced by T-sectioned integral ribs or stiffeners 24. This produces a high, if not optimum, strength-to-weight ratio, which is highly advantageous in aircraft, aerospace, and other applications where weight is heavily penalized.

Figure 2:
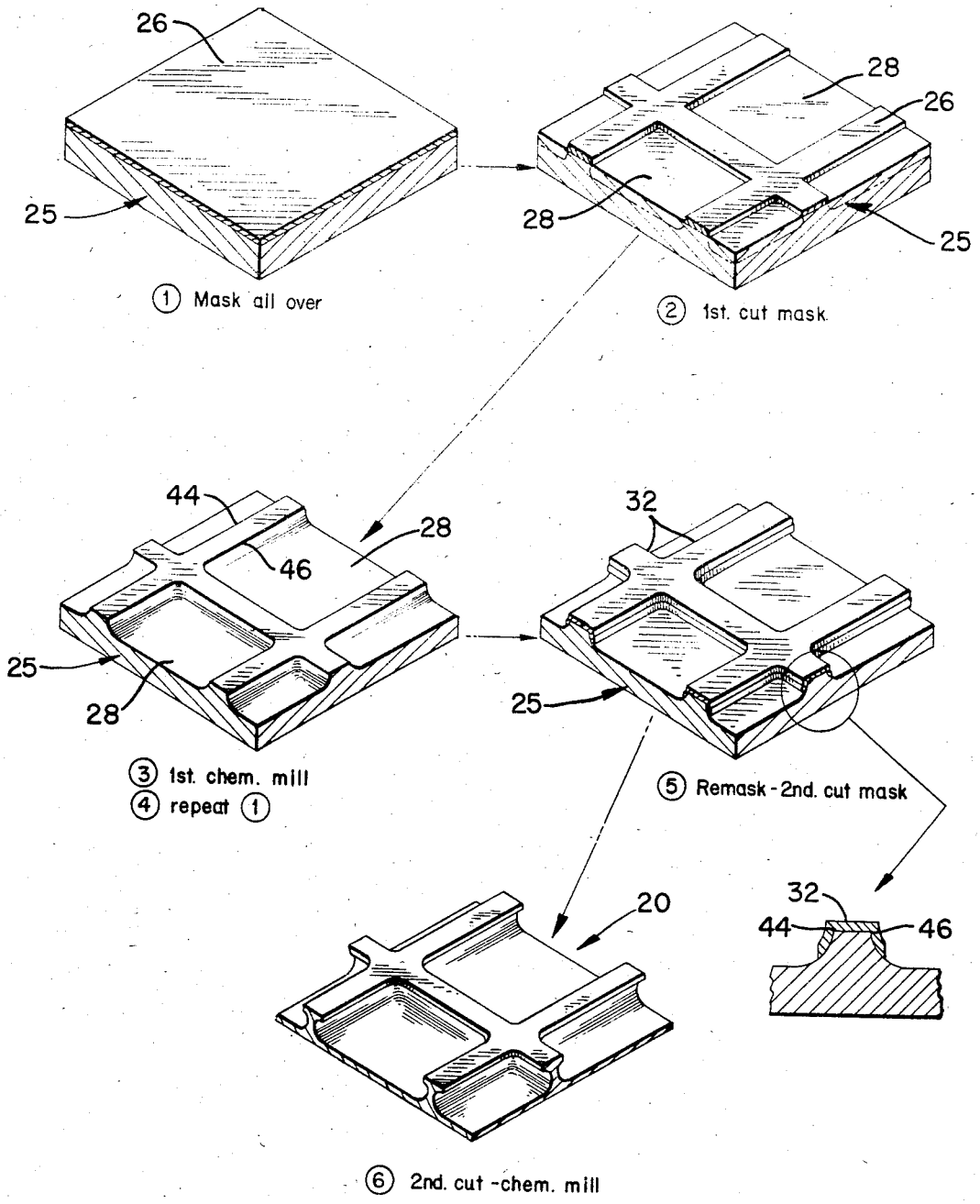
FIG. 2 illustrates, pictorially, the steps involved ih manufacturing the component of FIG. 1 by chemical milling.

To manufacture component 20, an appropriate blank or workpiece 25 is covered with a mask 26 as shown in FIG. 2.

The next step in my novel process is to strip the mask 26 from those areas 28 of the blank where metal is to be removed. At the end of this step the structure will appear as shown at "2" in FIG. 2.

Next, the blank is immersed in a bath of chemical milling solution contained in a conventional vat or tank (not shown) to remove metal from the unmasked areas of the workpiece.

At the end of the chemical milling step, the workpiece 25 is withdrawn from the vat and the mask 26 stripped away.

After mask 26 is stripped away, the workpiece will have the configuration shown at "3" in FIG. 1. The exposed areas 28 have been reduced approximately 50 percent in thickness, leaving ribs 24 with a truncated cross-section in the areas protected by mask 26.

At this stage in my process the structure has a substantially less than optimum strength-to-weight ratio. This ratio can be materially increased by further metal removal in accord with the principles of the present invention.

The next step in my process is to remask the workpiece 25. Next, the second mask 32 is stripped away from those areas of the structure where the removal of additional metal is wanted.

For example, in the exemplary application of my invention shown in FIG. 2, the masking material is stripped from the areas 28 so that the thickness of the original stock in these areas will be further reduced to form skin 22. Also, the masking material is stripped from those parts of the ribs or stiffeners 24 which will become the webs 36 of the stiffeners, leaving only what will be the flanges 38 and outer surfaces 40 of the stiffeners covered and protected from chemical attack.

After mask 32 is selectively stripped away as just described, the workpiece is again immersed in a chemical milling solution, which may be identical to that used in the first metal removal step, to effect the wanted removal of additional metal. At the end of this step, the workpiece is withdrawn from the chemical milling solution; and mask 32 is stripped from the workpiece, optionally first washing and/or otherwise treating the workpiece as described above.

The stripping away of mask 32 completes the process, leaving component 20 with the skin and integral, I-sectioned stiffener configuration shown at "36" in FIG. 1.

As thus far described, the novel chemical milling process disclosed herein may duplicate that patented in U.S. Pat. No. 4,113,549, cited above and in U.S. Pat. No. 4,137,118 issued Jan. 30, 1979, also to Brimm. Those patents are assigned to the assignee of this application and are hereby incorporated in this application by reference to furnish further details of the process discussed above and a novel etching fixture in which the milling process can advantageously be carried out.

The novel chemical milling process I have invented differs from that disclosed in U.S. Pat. Nos. 4,113,549 and 4,137,118 primarily in the composition of the milling solutions which, among others, has the advantage that the same solution can be used in both of the chemical milling steps employed in that exemplary application of my invention discussed above.

I pointed out previously that those solutions contain a hydroxide and a nitrate in an aqueous carrier and, preferably, a diol if an extrusion is being milled and a polyol if the workpiece is a forging. The generic formulas for the etching solutions were set forth above. One exemplary specific formula contained:

Sodium Hydroxide (NaOH), 100 grams/liter
Sodium Nitrate ($NaN0_3$), 50 grams/liter
Ethylene Glycol, 7% by Volume
Water, balance.

Figure 3:
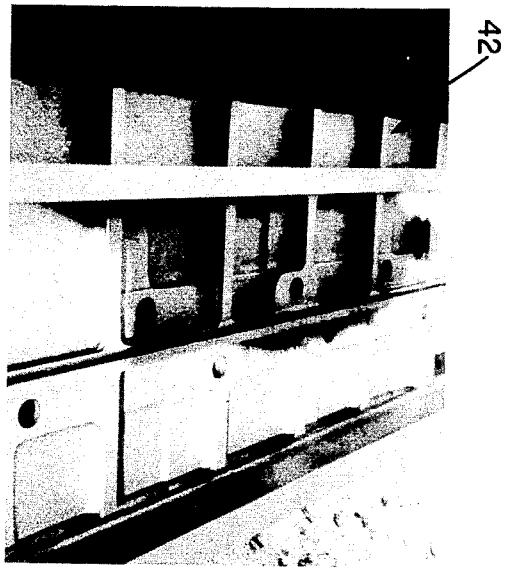
FIG. 3 is a photograph of an actual component manufactured by chemical milling in accord with the principles of my invention.

FIG. 3 shows a component 42 that was manufactured by chemically milling an Al 2219 extrusion in that solution using the process described above and illustrated in FIG. 2 except that three cycles of masking, scribing, and immersion in the chemical milling solution were employed.

Figure 4:
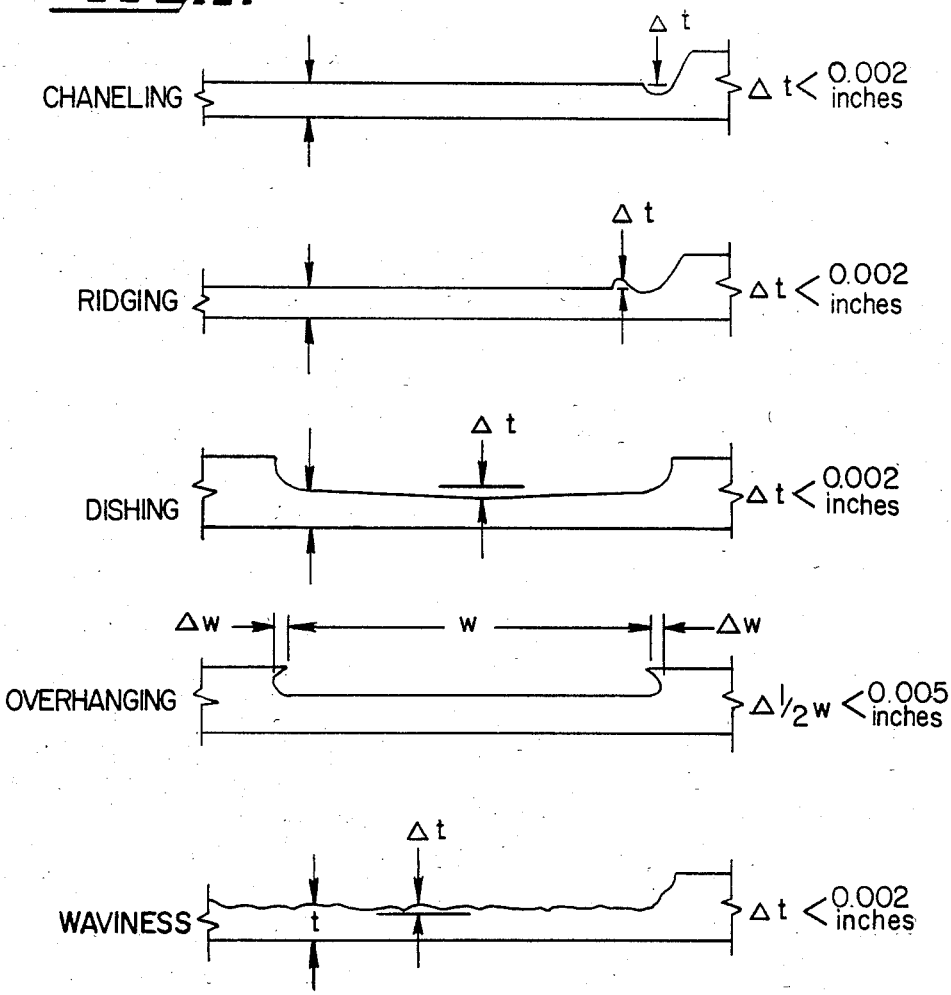
FIG. 4 shows various defects that arise in chemical milling processes and typical, maximum limits on those defects that can be tolerated.

Noteworthy are the stright etch lines (e.g., 44 and 46 in FIG. 2), which are a requisite for uniform fillets; the smooth fillets; and the smooth surfaces as well as the absence of defects such as channeling, ridging, dishing, overhanging, and waviness. These defects are illustrated in FIG. 4. That figure also shows the maximum permissible limits of these defects that can exist in a useful structure (the exceeding of the specified limits is accompanied by a degradation of strength and the generation of potential areas of failure).

Components chemically milled from aluminum alloys containing high amounts of copper and zinc by using the solution of the present invention are far superior in the respects discussed above to those that can be produced by using any other solution that I have been able to find. This was established by a study in which two inch by two inch by 0.5 inch thick coupons of Al 2219 alloy were cleaned conventionally by vapor degreasing and an alkaline bath to remove dirt, grease, and other foreign material; rinsed in water; deoxidized, again conventionally; and rinsed.

The coupons were then masked as described above and in U.S. Pat. Nos. 4,113,549 and 4,137,118. The masking was removed from a one inch square area on one side of the coupon, and the latter was then immersed in the solution being tested.

The milling rate was determined by measuring the depth or metal removal after 10 minutes.

After determining the milling rate, the sample was returned to the solution for sufficient time to produce a milled depth of 0.150 inch. This took from 300 to 400 minutes.

After milling to a depth of 0.150 inches, the sample was removed and examined to determine straightness of etch lines, smoothness of fillets and smoothness of surfaces.

Coupons which were clearly unacceptable were discarded at this juncture. Those which survived were remasked and scribed and reimmersed in the test solution until a second 0.150 inch thick layer of metal had been removed. This was followed by examination of the coupon.

With the sole exception of those disclosed herein, the solutions and procedures I tested failed to produce acceptable results. In every other case the coupon exhibited poor etch lines rough surfaces, waviness, tapering, chamfering, and/or channeling with these defects becoming much more pronounced after the second cycle.

Also, the undercut radius was irregular. A regular undercut is required for a uniform light weight structure of high strength.

Solutions which were evaluated in this manner included those disclosed in U.S. Pat. Nos. 2,795,491; 3,300,349; and 3,356,550 and stated to be useful to etch aluminum alloys containing copper and zinc. Other solutions, including some that were commercially available, that appeared to potentially be useful were also tested. The recommended procedures and parameters such as the temperature of the solution were employed.

Representative forms of my invention have been described above, but the invention may be embodied in other specific forms without departing from the spirit or essential characteristics thereof. The disclosed embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patents of the United States is:

1. A composition for chemically milling aluminum and aluminum alloys, said composition consisting of a solution of an alkali metal hydroxide or ammonium hydroxide and an ammonium nitrate or alkali metal nitrate in water, said solution containing from 80 to 120 grams of hydroxide and from 42 to 65 grams of nitrate per liter of solution calculated as the sodium salts.

2. A composition for chemically milling aluminum and aluminum alloys as defined in claim 1 wherein the hydroxide is sodium hydroxide and wherein the nitrate is sodium nitrate.

3. A composition as defined in claim 2 which contains about 100 grams per liter of sodium hydroxide.

4. A composition as defined in claim 2 which contains about 50 grams per liter of sodium nitrate.

5. A composition for chemically milling aluminum and aluminum alloys, said composition consisting of a solution of an alkali metal hydroxide or ammonium hydroxide and an ammonium nitrate or alkali metal nitrate in water and from six to eight percent of a surface smoothness enhancer, said solution containing from 80 to 120 grams of hydroxide and from 42 to 65 grams of nitrate per liter of solution calculated as the sodium salts and said surface smoothness enhancer being ethylene glycol or glycerin.

6. A composition as defined in claim 5 in which the hydroxide is sodium hydroxide.

7. A composition as defined in claim 5 in which the nitrate is sodium nitrate.

8. A composition for chemically milling aluminum and aluminum alloys, said composition consisting of a solution of an alkali metal hydroxide or ammonium hydroxide and an alkali metal nitrate or ammonium nitrite in water, said solution containing from 80 to 120 grams of hydroxide calculated as the sodium salt and an amount of nitrite which is the equivalent of from 42 to 65 grams of nitrate per liter of solution calculated as the sodium salts.

9. A composition as defined in claim 8 wherein the hydroxide is sodium hydroxide.

10. A composition as defined in claim 8 wherein the nitrite is sodium nitrite.

11. A method of chemically milling an aluminum or aluminum alloy workpiece to impart a selected shape thereto which comprises the steps of: cleaning said workpiece and masking any portions thereof in which the removal of metal is not wanted and thereafter immersing the workpiece for an extended period of time in a chemical milling solution consisting of an alkali metal hydroxide or ammonium hydroxide, an alkali metal nitrate or ammonium nitrate, and water, there being from 80 to 120 grams of hydroxide and from 42 to 65 grams of nitrate calculated as the sodium salts per liter of solution.

12. A method of chemically milling an aluminum or aluminum alloy workpiece as defined in claim 11 in which the hydroxide is sodium hydroxide and in which the nitrate is sodium nitrate.

13. A method as defined in claim 12 in which the chemical milling solution contains about 100 grams per liter of sodium hydroxide.

14. A method as defined in claim 12 or 13 in which the chemical milling solution contains about 50 grams per liter of sodium nitrate.

15. A method as defined in claim 11 or in claim 12 in which the workpiece is a copper or zinc containing aluminum alloy.

16. A method as defined in claim 15 in which the aluminum alloy is an alloy having the nominal composition 6.3Cu-0.3Mn-0.18Zr-0.10V-0.06Ti-Al.

17. A method of chemically milling of an aluminum alloy having the nominal composition 6.3Cu-0.3Mn-0.18Zr-0.10V-0.06Ti-Al extrusion or forging to impart a selected shape thereto which comprises the steps of: cleaning said workpiece and masking any portions thereof in which the removal of metal is not wanted and thereafter immersing the workpiece for an extended period of time in a chemical milling solution consisting of an alkali metal hydroxide or ammonium hydroxide, an alkali metal nitrate or ammonium nitrate, a surface smmothness enhancer, and water, there being from 80 to 120 grams of hydroxide and from 42 to 65 grams of nitrate calculated as the sodium salts per liter of solution and said surface smoothness enhancer being ethylene glycol or glycerin and being present in an amount of six to eight percent based on the volume of the solution.

18. A process as defined in claim 11 or in claim 17 in which the chemical milling solution is maintained at a temperature in the range of 190° to 200° F. while the workpiece is immersed therein.

19. A method as defined in claim 11 or in claim 17 wherein the workpiece has at least one weld or other heat affected zone.

20. A method as defined in claim 17 in which the workpiece is an extruded Al 2219 aluminum alloy with the aforesaid nominal composition and the surface smoothness enhancer is ethylene glycol.

21. A method of chemically milling an aluminum or aluminum alloy workpiece to impart a selected shape thereto which comprises the steps of: cleaning said workpiece and masking any portions thereof in which the removal of metal is not wanted and thereafter immersing the workpiece for an extended period of time in a chemical milling solution consisting of an alkali metal hydroxide or ammonium hydroxide, an alkali metal nitrite or ammonium nitrite, and water, there being from 80 to 120 grams of hydroxide calculated as the sodium salt and an amount of nitrite which is the equivalent of from 42 to 65 grams of nitrate calculated as the sodium salts per liter of solution.

22. A method as defined in claim 21 in which the workpiece is a forging of an aluminum alloy having the nominal composition 6.3Cu-0.3Mn-0.18Zr-0.10V-0.06Ti-Al and the surface smoothness enhancer is glycerin.

23. A process of chem-milling aluminum and aluminum alloys comprising the steps of adding from 45 to 65 g/1 of sodium nitrate to a chem-milling composition which contains sodium hydroxide and continuing the chem-milling until the concentration of dissolved aluminum in the solution is increased.

24. In a chem-milling composition comprising sodium hydroxide as the principal active ingredient and a diol or triol, the improvement which comprises the addition of from 45 to 65 g/1 of sodium nitrate per liter of chem-milling solution.

25. The composition of claim 24 wherein the etching rate of the chem-milling composition is increased and the tank life of the composition is increased as compared to a similar composition not containing the sodium nitrate.

26. A composition as defined in claim 5 in which the surface smoothness enhancer constitutes from 7.1 to 10 volume percent.

27. A composition as defined in claim 5 in which the surface smoothness enhancer constitutes from 6 to 8 volume percent.

28. A method of chemically milling an aluminum or aluminum alloy workpiece as defined in claim 11 wherein the workpiece is fabricated of an aluminum alloy having a nominal composition of:

6.3Cu-0.3Mn-0.18Zr-0.10V-0.06Ti-Al,
4.4Cu-0.6Mn-1.5Mg-Al,
1.6Cu-2.5Mg-5.6Zn-0.23Cr-AI,
0.6Cu-3.3Mg-0.18Cr-4.3Zn-0.20Mn-Al, or
0.30Cu-0.6Si-1.OMg-0.20Cr-Al.

29. A method as defined in claim 11 wherein the temperature of said chemical milling solution is maintained in the range of 190°–200° F. during the period in which metal is removed from said workpiece.

30. A composition as defined in claim 24 in which the diol is ethylene glycol and the triol is glycerin.

* * * * *